US009826810B2

(12) United States Patent
Singer

(10) Patent No.: US 9,826,810 B2
(45) Date of Patent: Nov. 28, 2017

(54) COMPACT POCKET ORGANIZER FOR KEYS, CARDS, CURRENCY AND TOOLS

(71) Applicant: Left Field Design, LLC, Menlo Park, CA (US)

(72) Inventor: Richard W. Singer, Menlo Park, CA (US)

(73) Assignee: Left Field Design, LLC, Menlo Park, CA (US)

( * ) Notice: Subject to any disclaimer, the term of this patent is extended or adjusted under 35 U.S.C. 154(b) by 450 days.

(21) Appl. No.: 14/471,270

(22) Filed: Aug. 28, 2014

(65) Prior Publication Data

US 2015/0059937 A1 Mar. 5, 2015

Related U.S. Application Data

(60) Provisional application No. 62/013,834, filed on Jun. 18, 2014, provisional application No. 61/872,338, filed on Aug. 30, 2013.

(51) Int. Cl.
*A45C 1/06* (2006.01)
*A45C 11/18* (2006.01)
*A45C 11/32* (2006.01)

(52) U.S. Cl.
CPC ..... *A45C 11/182* (2013.01); *A45C 1/06* (2013.01); *A45C 11/32* (2013.01); *A45C 11/321* (2013.01); *A45C 11/324* (2013.01); *A45C 2001/062* (2013.01); *A45C 2001/065* (2013.01); *A45C 2001/067* (2013.01)

(58) Field of Classification Search
CPC ... A45C 2001/065; A45C 1/06; A45C 11/182; A45C 11/18; B42F 7/06
USPC ..... 150/147, 112, 137; 206/37.4, 37.6, 37.8, 206/38, 38.1, 39, 39.5, 449, 534.2; 24/3.7, 67.9, 499, 489; 362/116; 70/456 R
See application file for complete search history.

(56) References Cited

U.S. PATENT DOCUMENTS 1,206,074 A * 11/1916 Bryner ..... A44B 15/002 224/666
1,579,153 A * 3/1926 Seeler ..... A45C 11/324 24/3.6
1,857,488 A * 5/1932 Weeks ..... B42F 1/06 150/137
2,659,379 A * 11/1953 Caserta ..... A45D 8/14 132/276
3,027,995 A * 4/1962 Littman ..... A45C 1/02 206/0.81
D220,424 S * 4/1971 Hindenburg ..... D8/395
D251,124 S * 2/1979 Takeuchi ..... D19/65
D292,717 S * 11/1987 Murtagh ..... D19/65
5,115,909 A * 5/1992 Hull ..... A45C 1/06 150/137
D363,453 S * 10/1995 Herdt ..... D11/78.1
5,697,127 A * 12/1997 Tyler ..... A45C 1/06 206/69
D740,113 S * 10/2015 Olenick ..... D8/399
(Continued)

*Primary Examiner* — Fenn C Mathew
*Assistant Examiner* — Cynthia Collado

(57) ABSTRACT

Small form-factor apparatus and methods for holding, securing, and accessing personal items normally carried on a keychain and in a wallet including, for example, keys, USB drive, bottle opener, driver's license, credit-cards, RFID cards and paper currency are disclosed.

11 Claims, 11 Drawing Sheets

(56) References Cited

U.S. PATENT DOCUMENTS

2005/0103070 A1* 5/2005 Meyerson ..... A45F 5/02
70/456 R

* cited by examiner

COMPACT POCKET ORGANIZER FOR KEYS, CARDS, CURRENCY AND TOOLS

This application claims the benefit under 35 U.S.C. 119(e) of U.S. Provisional Application No. 62/013,834 filed on Jun. 18, 2014, and of U.S. Provisional Application No. 61/872,338 filed on Aug. 30, 2013, each of which is incorporated by reference in its entirety.

FIELD

The present disclosure relates to small form-factor apparatus and methods for holding, securing, and accessing the personal items normally carried on a keychain and in a wallet including, for example, USB drive, driver's license, credit-cards, RFID cards and paper currency.

BACKGROUND

Conventional wallets and key holders are inherently bulky and, when worn in pants pockets, cause pocket-bulge that is both uncomfortable and unsightly. Wallets that are obvious where worn also increase vulnerability to pickpockets. Key rings and key chains are particularly uncomfortable because keys naturally splay in a pants pocket, causing key serrations and pointed tips to poke anatomy. Key organizers in pocket-knife embodiments cannot be used single-handedly. Money clips, because they are small and have a limited moment-arm, yield easily and then no longer securely hold one or several paper bills. Because credit cards and ID are not enveloped by a money-clip, these cards are easily dislodged. The clips on combination card holders and money clips tend to be either short leaf springs or hinged magnets, which respectively yield easily and do not provide a secure grip with more than a few bills. Unloaded card holders with segmented compartments are inherently thick because of the material stack-up. Single-compartment card holders without an elastic member do not securely hold more than a few cards. Card holders with an elastic member compromise easy card access and the elastic relaxes over time, compromising card retention. Card holders and wallets made from stitched leather or fabric wear out over time from worn stitching. Radio frequency identification (RFID) credit cards can be non-invasively read with a portable scanner, through non-shielded wallets and clothing. With over two hundred million RFID cards in circulation, unauthorized RFID scanning is a common cause of ID theft.

SUMMARY

The wallet and key organizers provided by the present disclosure describe a resilient spring-clip to envelop credit cards and also contain keys as part of a thin laminate with keys held between the outside of the spring-clip and a cover plate. In certain embodiments, the spring-clip and the key organizer are not combined, so that they are independent in both form and function, minimizing the thickness of each, and the key organizer holds keys between two plates of the same length and width. The term card clip as used herein refers to a modified money-clip intended to envelop and hold credit cards, cash and/or ID. The term combination wallet as used herein refers to a combined card-clip and key organizer.

The RFID blocking card provided by the present disclosure, describes a compact shield for preventing unauthorized scanning of RFID cards held in the card clip, combination wallet, or most non-RFID blocking wallets and card holders.

In a first aspect, card clips for holding credit cards are provided, comprising a plate wherein a first portion of the plate is folded back over a second portion of the plate, wherein, the first portion comprises a window and a flared end configured to receive credit cards; and the second portion is substantially flat.

In a second aspect, key organizers are provided, comprising: a backing plate comprising: three or more internally-threaded bosses peripherally arranged toward sides of the backing plate and configured to mechanically mount keys and/or tools; and a cover plate comprising key access slots configured to rotate keys with a thumb or index finger, wherein the cover plate is mounted over the backing plate.

In a third aspect, devices are provided comprising: a card clip comprising: a plate wherein a first portion of the plate is folded back over a second portion of the plate, wherein, the first portion comprises a window and a flared end configured to receive credit cards; and the second portion is substantially flat; and at least three internally-threaded bosses mounted to an outside surface of the second portion of the clip, wherein at least three bosses are peripherally arranged toward edges of the second portion and are configured to mechanically mount keys or tools; and a cover plate comprising key access slots configured to rotate keys with a thumb or index finger, wherein the cover plate is mounted over the card clip.

In a fourth aspect, RFID blocking shields are provided comprising a thin, composite material laminated to a metalized fabric.

Other features of the present disclosure will become apparent from the following detailed description.

Reference is now made to certain embodiments of clips, organizers, combination clips and organizers, and RF blocking cards. The disclosed embodiments are not intended to be limiting of the claims. To the contrary, the claims are intended to cover all alternatives, modifications, and equivalents.

DETAILED DESCRIPTION

Figure 1:
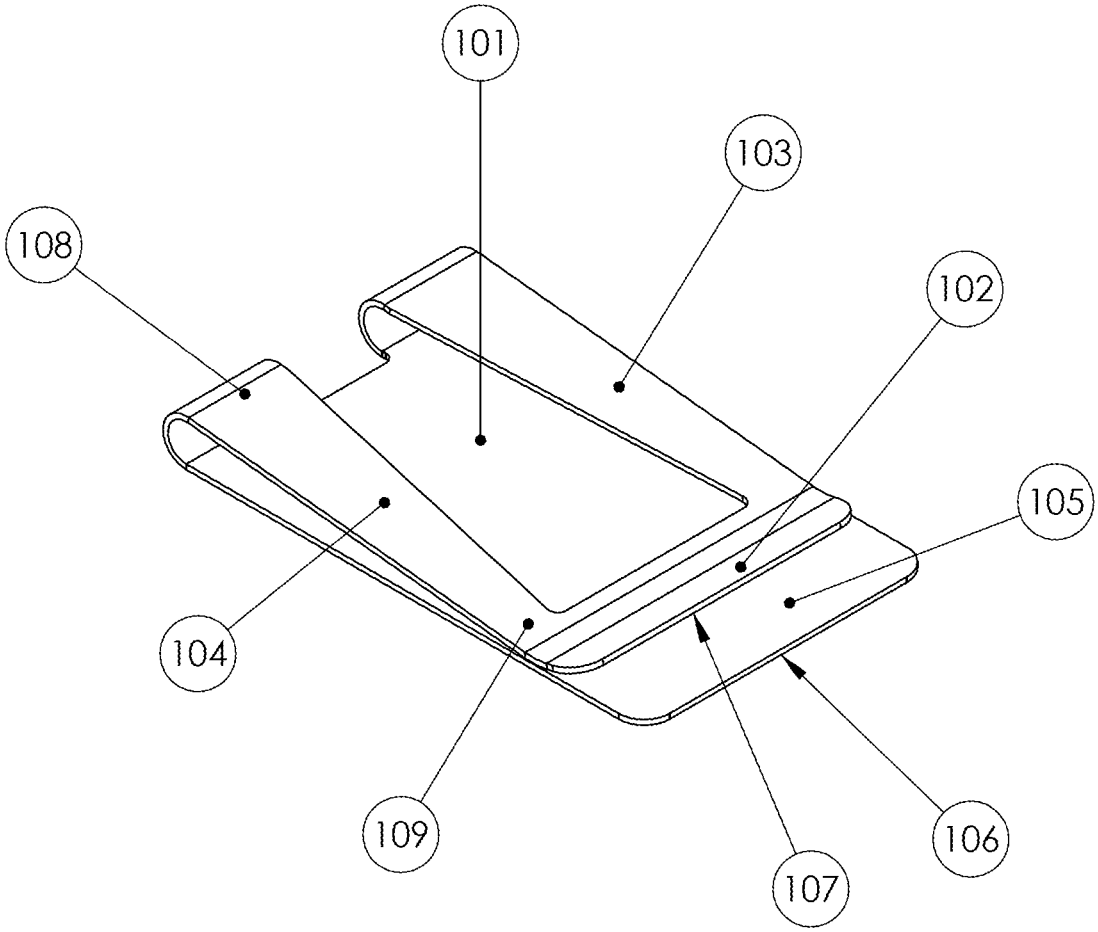
FIG. 1 shows a perspective view of a card clip in accordance with certain embodiments of this disclosure.

The card clip comprises a three-sided housing that grips and envelops credit-cards, folded paper currency, ID, and business cards. In a particular embodiment, the profile of the card clip is a tear drop shape, with the two long sides in contact at their ends, and with at least one of the ends flared to receive and grip cards, currency and ID. One of the long sides has a trapezoidal opening, effecting two long, tapered beams on either side of the opening, and a void between the tapered beams so that cards and cash are visible, accessible and readily available. The length of the beam, combined with a root width that is twice as wide as the tip, increases leaf-spring elasticity and fatigue resistance. The width of the opening between the tapered beams controls spring resistance, and also permits a thumb or finger to push cards outward from the clip, with cards still held by the clip, allowing the user to easily select, remove and insert a single card or cash. The side opposite from the tapered beams is an unrelieved and smooth surface to prevent magnetic tape abrasion on cards that include magnetic tape.

In certain embodiments, the card clip wallet is fabricated from composite material and/or metal that, unlike leather or fabric wallets and card-holders, does not include stitching that is vulnerable to wear, and when used with the RFID blocking card described herein, prevents unauthorized scanning of RFID cards.

The key organizer provided by the present disclosure comprises: a rigid backing plate with threaded bosses that are peripherally arranged for key-mounting; a protrusion, or protrusions in the middle of the backing plate for limiting rotational travel of the keys; washers provided as spacers when keys are not installed; curved, disc springs provided for holding the keys in place when rotationally extended or refracted; a cover-plate assembly consisting of a rigid plate with slots over the keys for key access, countersunk holes, and thin wear-washers adhered to the side of the cover plate opposite the countersinks and concentric to the holes; and flathead screws which fasten the cover-plate assembly to the backing plate's threaded protrusions and compress the disc springs when washers, keys, and/or tools such a flash-memory drive, bottle opener, screwdriver, or LED flashlight are installed. Cover plate key access slots are sized for the thumb, so that keys can be rotated open or closed with one hand.

In an embodiment of this disclosure, the backing plate material is 1 millimeter-thick stainless steel with press-fit, internally-threaded standoffs and the cover plate material is 2 millimeter-thick aluminum so that the key organizer can be durable, rigid, thin and unobtrusive when in a pants pocket. Both the backing plate and cover plate have a corner radius of at least 3 millimeters on each corner and deburred edges for comfortable wear and handling. This embodiment has a backing plate and a cover plate that are the same length and width of a credit card for compactness and dimensional compatibility with most non-vehicle keys available in North America, but the width and length could increase to fit with larger keys that are more common in Asia and in Europe.

In certain embodiments of this disclosure the height of the internally threaded, backing plate standoffs are 1 millimeter greater than the thickness of one standard key thickness (2 mm), or 1 millimeter more than the aggregate of multiple key thickness, so that the keys can be held in compression with disc springs, cover plate and screws installed, and so that rotational key resistance does not vary and the screws do not loosen when the cover is screwed tightly against the threaded protrusions of the backing plate.

An embodiment of this disclosure has three backing plate key positions: two positions having keys inset from the long sides, with adjacent key heads just inset from a short side; and a third position having a key or keys inset from the short side and the key head or key heads inset from one of the long sides. Since all keys are contained within the backing plate and cover, nothing sharp or pointed protrudes from the key organizer envelope. Internally threaded backing plate standoffs may be metric because off-shelf metric standoffs are available in 2 mm height increments that match increases in height when keys are stacked on top of each other, providing the same disc spring gap with the cover plate when one or more keys are stacked. In this arrangement, backing plates can be assembled with standoff heights that support key quantities in multiples of three, for example, three-key backing plates or six-key backing plates. Since backing plates support key quantities in multiples of greater than two, the thickness of the modified product is minimized.

In another embodiment of this disclosure, a removable key ring is provided with a backing plate washer to replace a key and to provide an attachment mechanism for oversized keys such as vehicle keys that are, or include, wireless electronic devices.

In certain embodiments of this disclosure, flathead screws are specified so that, taken together with the backing plate's press-fit standoffs, all hardware is flush or below flush to prevent dermal abrasion or abrasion of anything in contact with the key organizer. In certain embodiments of this disclosure a nylon patch is specified on the threads of the screw to prevent screws from loosening.

The combination wallet provided by the present disclosure is the same as the fore-mentioned key organizer, except that the key organizer's backing plate is replaced with the fore-mentioned card clip housing, modified to include press-fit, internally threaded standoffs installed in the unrelieved side of the housing that is opposite from the windowed side and with the standoff protrusions on the outside of the housing. Advantages of this construction include a common blacking plate for keys and cards, common tooling for the card clip and combination wallet described herein, as well as a common cover plate shared by the key organizer and the combination wallet. Henceforth, the modified card clip housing will be referred to as the combination backing plate.

In certain embodiments of this disclosure the height of the internally threaded, combination backing plate standoffs are 1 millimeter greater than the thickness of one standard key thickness (2 mm), or 1 millimeter more than the aggregate of multiple key thickness, so that the keys can be held in compression with disc springs, cover plate and screws installed, and so that rotational key resistance does not vary and the screws do not loosen when the cover is screwed tightly against the backing plate's threaded protrusions.

An embodiment of this disclosure has three combination backing plate key positions: two positions having keys inset from the long sides, with adjacent key heads just inset from a short side; and a third position having a key or keys inset from the short side and the key head or key heads inset from one of the long sides. Since all keys are contained within the cover and combination backing plate, nothing sharp or pointed protrudes from the combination wallet envelope.

Internally threaded combination backing plate standoffs may be metric because off-shelf metric standoffs are available in 2 mm height increments that match increases in height when keys are stacked on top of each other, providing the same disc spring gap with the cover plate when one or more keys are stacked. In this arrangement, combination backing plates can be assembled with standoff heights that support key quantities in multiples of three, for example, a three-key combination backing plate or a six-key combination backing plate. Since combination backing plates support key quantities in multiples of greater than two, the thickness of the combination product is minimized.

In certain embodiments of this disclosure, flathead screws are specified so that screw heads are flush or below flush to prevent dermal-abrasion or abrasion of anything in contact with the combination wallet. A nylon patch is specified on the threads of the screw to prevent screws from loosening. Combination backing plate standoffs are flush-mounted to prevent magnetic tape abrasion when cards with magnetic strips are inserted or removed from the combination wallet.

The card clip component, of the combination wallet, is the combination backing plate, and comprises a three-sided housing that grips and envelops credit-cards, folded paper currency, ID, and business cards. In a particular embodiment, the profile of the card clip component is a tear drop shape, with the two long sides in contact at their ends, and with at least one of the ends flared to receive and grip cards, currency and ID. One of the long sides has a trapezoidal opening, effecting two long, tapered beams on either side of the opening, and a void between the tapered beams so that cards and cash are visible, accessible and readily available. The length of the beam, combined with a root width that is twice as wide as the tip, increases leaf-spring elasticity and fatigue resistance. The width of the opening between the tapered beams controls spring resistance, and also provides card access so a thumb or finger can push cards outwards from the clip, with cards still held by the clip, allowing the user to easily select, remove and insert a single card or cash. The side opposite from the tapered beams is an unrelieved and smooth surface, with flush mounted standoffs installed flush or below flush, to prevent magnetic tape abrasion on cards that include magnetic tape.

In certain embodiments, the combination wallet is fabricated from composite material and/or metal that, unlike leather or fabric wallets and card-holders, does not include stitching that is vulnerable to wear, and when used with the RFID blocking card described herein, prevents unauthorized scanning of RFID cards.

The RFID blocking card, provided by the present disclosure includes a thin, credit card sized, composite material, laminated with metalized fabric. In certain embodiments, the RFID blocking card is held within a card clip provided by the present disclosure, to prevent unauthorized scanning of RFID cards contained between the RFID blocking card and the unrelieved side of the card clip.

The RFID blocking card is fabricated from a material that is softer than the card clip and non-abrasive, so it cannot abrade the card clip, or combination wallet backing plate, which might then abrade magnetic tape when cards are inserted or removed.

In certain embodiments, two RFID blocking cards are used to sandwich RFID cards within a non-RFID blocking wallet, or card holder, to prevent unauthorized RFID scanning of RFID cards.

The FIG. 1 card clip of the present disclosure is shown empty and in a pre-loaded condition, but can hold multiple cards and cash between the flat side 101, that is at least the width and length of a credit card for enveloping such cards, and the flared bridge 102 that joins two stiff, tapered leaf springs 103 and 104. The side of card clip disclosed herein that comprises leaf springs 103 and 104 is as long as possible, to maximize leaf spring elasticity and fatigue resistance, and still provide for an adequately sized land 105, between the end of the flared bridge 102 and the non-hemmed end of the card clip 106, for inserting a card or cards at an acute angle into the flared opening 107 of the clip. A spring force equal to or greater than 7 pounds is preferred for securely holding cards, but such force makes opening the card clip with fingernails moderately difficult, so the fore-mentioned method of inserting a card or cards into the card clip provides a practical mechanical advantage. Leaf springs 103 and 104 are tapered, for uniform stress distribution and maximum elasticity, with a root width 108 that is about twice that of the tip width 109. Other relative dimensions of root width to tip width may be used provided that the spring force is sufficient to retain the inserts and also facilitates insertion of inserts such as credit cards.

Figure 2:
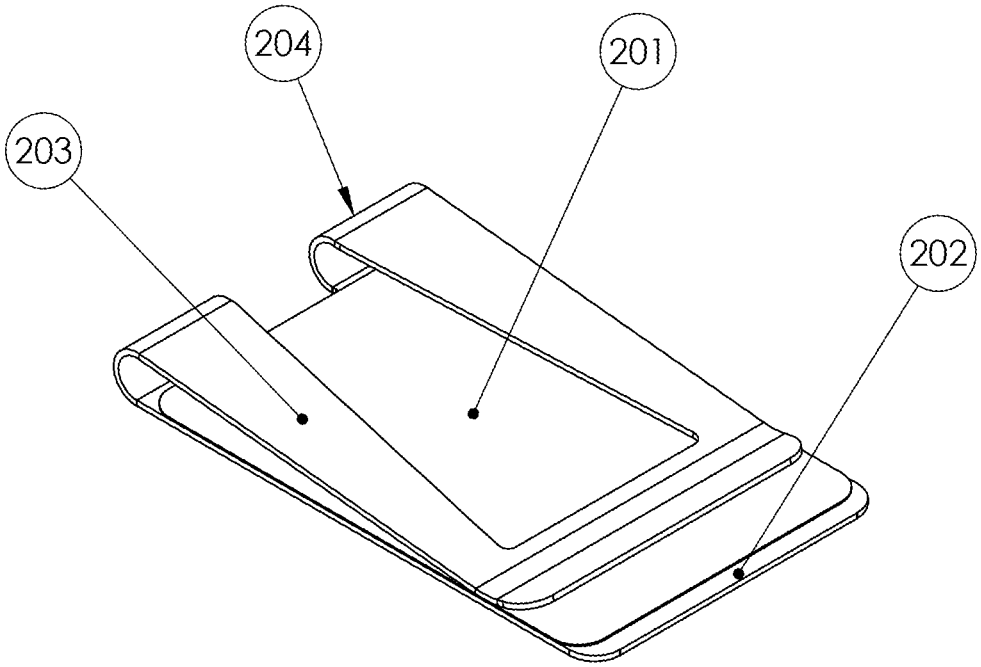
FIG. 2 shows a perspective view of a card clip holding an electrically conductive removable card in accordance with certain embodiments of this disclosure.

The FIG. 2 card clip of the present disclosure is shown holding a single card 201 that may be an electrically-conductive shield for blocking radio frequencies of RFID cards, which may be sandwiched between card 201 and the flat side 202 of the card clip disclosed herein. The card clip of the present disclosure is a three-sided housing having: a windowed side 203 for accessing a card 201, or multiple cards and paper currency; an unrelieved, flat side 202; and a hemmed side 204, which could alternatively replace the hem with a short, flat side, having 2 folds.

Figure 3:
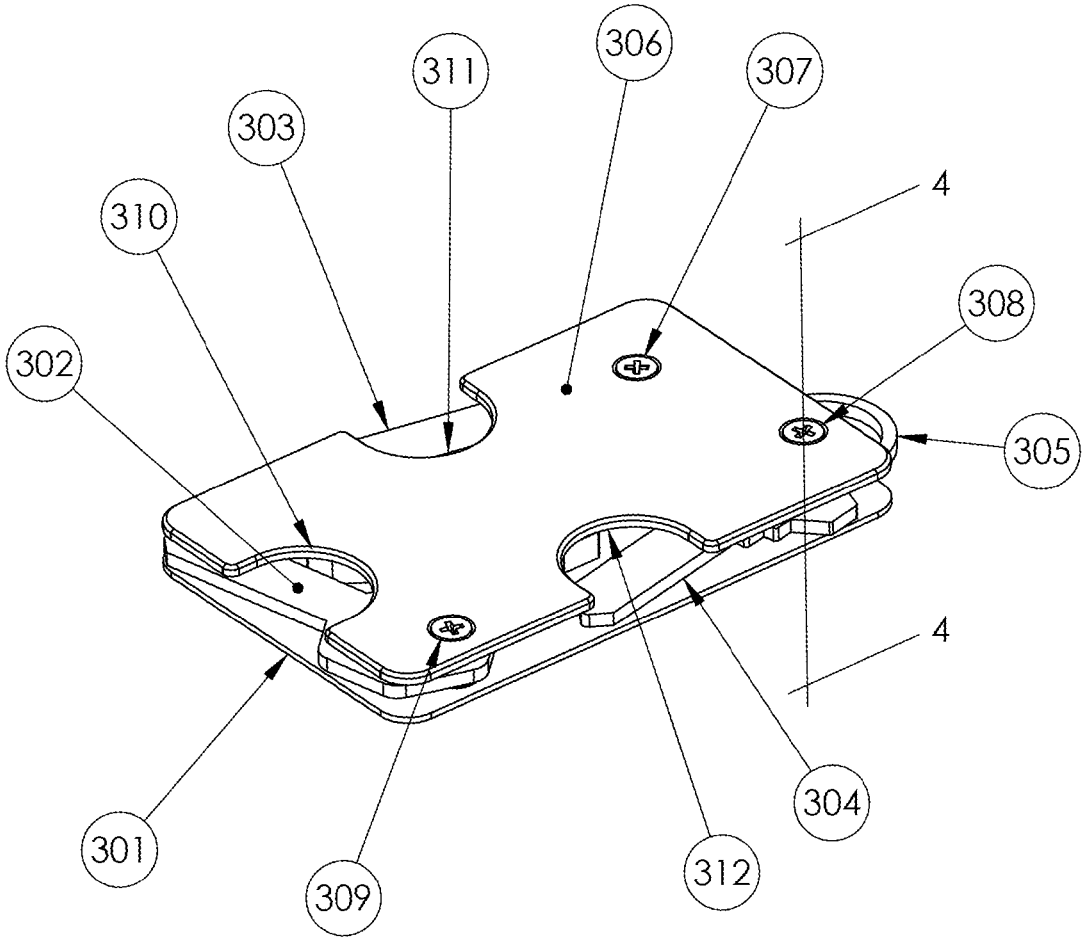
FIG. 3 shows a perspective view of a key organizer in accordance with certain embodiments of this disclosure.

FIG. 3 shows a key organizer of the present disclosure, with a backing plate 301 that holds keys 302, 303 and 304, or multiple keys, spacers (not shown), and a key ring 305 with two stacked layers of three items. Keys 302, 303 and 304 are shown in the retracted, or closed position, and the cover 306, key ring 305 and spacer, or spacers (not shown), are held in place by flathead screws 307, 308 and 309. Cover 306 key-access slots 310, 311 and 312 are located above the retracted keys 302, 303 and 304 and are sized and positioned so keys, which pivot around screws 307, 308 and 309, can be rotated open or closed single-handedly with a thumb or index finger. The cover 306 is held in place by more than one screw, so it cannot rotate and loosen screws 307, 308 and 309 when keys or tools, such as a USB flash drive or bottle opener, are rotated in and out of the key organizer of the present disclosure.

Figure 4:
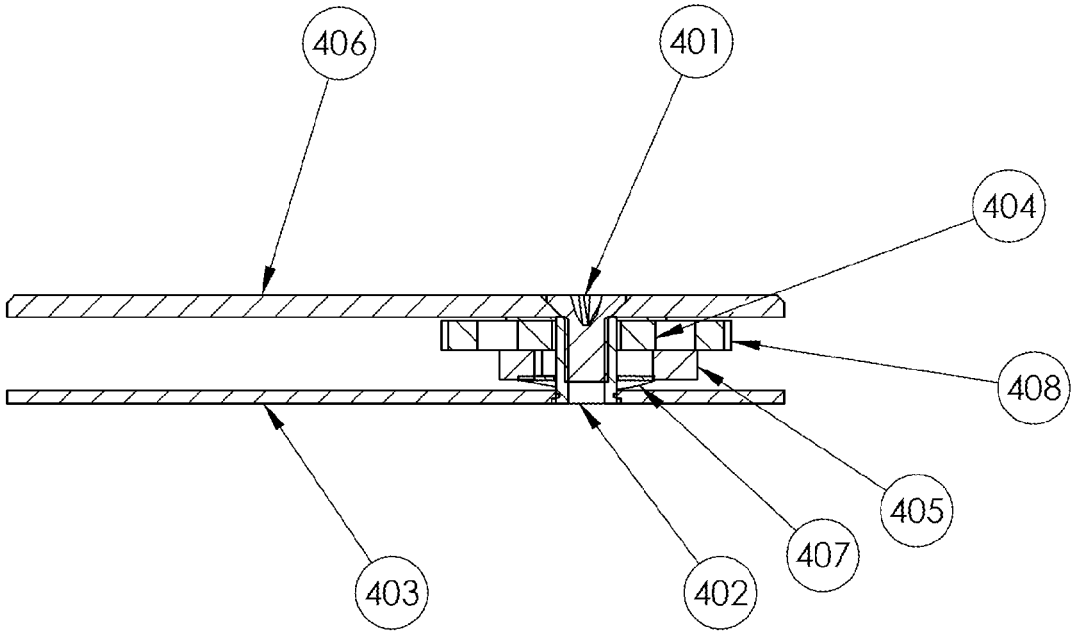
FIG. 4 shows a cross-sectional view taken along section 4-4 of FIG. 3, showing a key organizer hardware assembly, in accordance with certain embodiments of this disclosure.

FIG. 4 shows the laminated construction of the key organizer embodiment shown in FIG. 3. One of the three identical sets of hardware is shown, including flathead screw 401 and internally threaded backing plate standoff 402, which is press-fit into, and flush-mounted to, 1 millimeter thick backing plate 403. Off-shelf, internally-threaded M3 standoffs are available in 2 millimeter height increments, which match the thickness of a standard key, so metric M3 standoffs for thin sheet metal installation can be specified at heights of 4 millimeters, 6 millimeters and 8 millimeters to match stacked key thicknesses of one, two or three keys, and when installed in 1 millimeter-thick backing plate 403, the top of the specified standoff, illustrated by standoff 402, will always contact cover 406. Spacer 404, key 405, and disc spring 407 are held in compression between backing plate 403 and cover 406 by securely tightened screw 401. Although spacer 404, key ring 408, and key 405 are shown for purposes of illustration, two keys, or two spacers, or a tool equaling a key thickness, such as a bottle opener or screw driver, in combination with a key or spacer, or a tool such as a USB flash drive with a height approximately equal to 4 millimeters could also be used. Another advantage of the construction shown in this embodiment is that off-shelf M3 metric screws with sufficient thread engagement can be used with off-shelf M3 metric standoffs, to minimize hardware costs. Key case materials used in this embodiment include: nylon-patch screws, illustrated by screw 401, to resist loosening; 1 millimeter-thick stainless steel, in backing plate 403, for strength and a minimum cross-sectional thickness to install recessed standoffs; 2 millimeter-thick 6061-T6 aluminum, in cover plate 406, for a rigid plate with sufficient thickness to recess M3 flathead screw heads, illustrated by screw 401, while minimizing weight.

Figure 5:
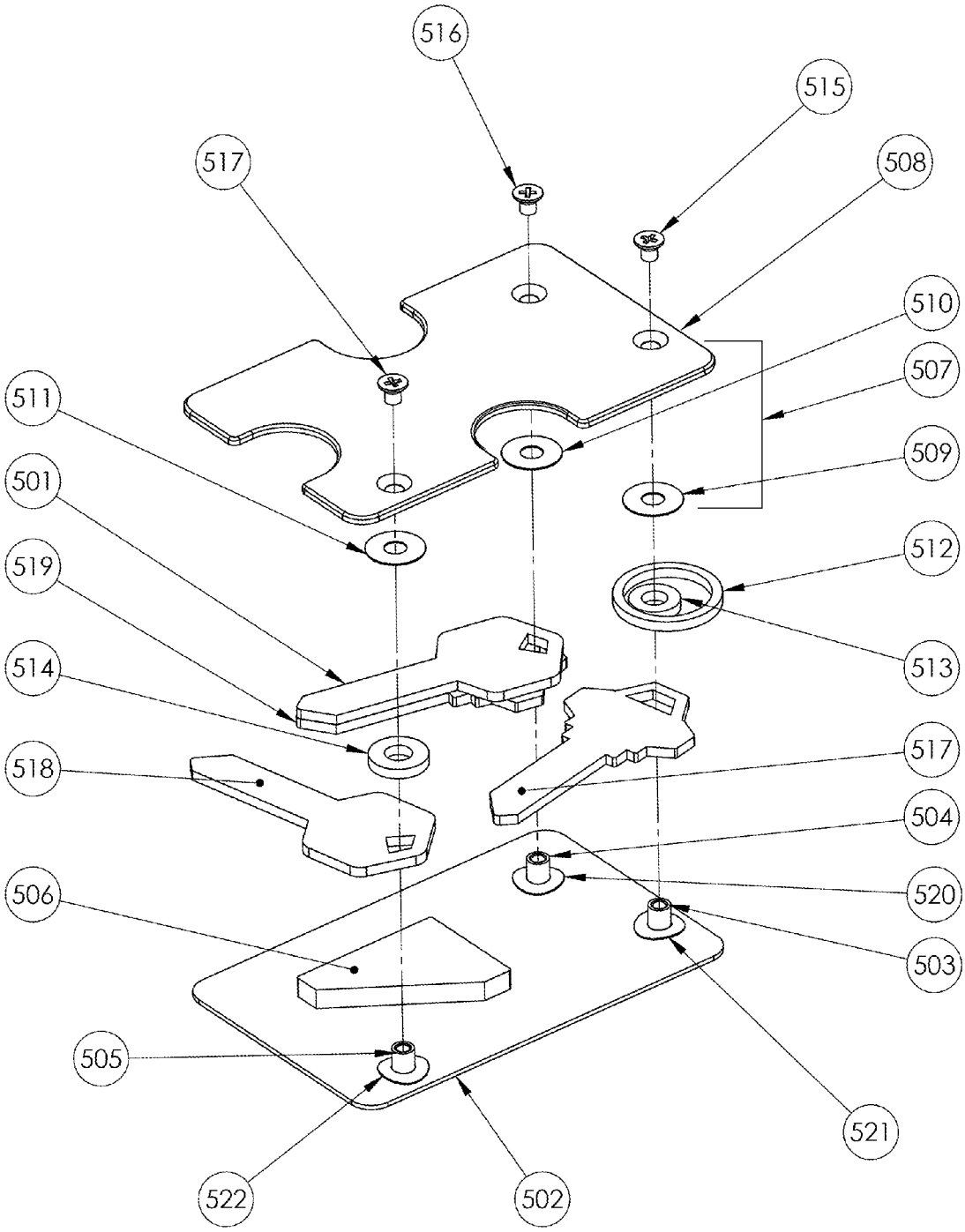
FIG. 5 shows an exploded assembly view of the FIG. 3 key organizer in accordance with certain embodiments of this disclosure.

With reference to FIG. 3, FIG. 5 shows an exploded assembly-view of the FIG. 3 key organizer, with a fourth key 501 shown. In this embodiment, backing plate 502 is a sub-assembly that includes internally-threaded, press-fit standoffs 503, 504 and 505, and key over-travel limit 506, that is permanently adhered to backing plate 502, and sized accordingly so that the height is less than the specified standoff height. The cover plate assembly 507 includes cover plate 508 and wear-resistant, thin-plastic washers 509, 510 and 511, which are permanently adhered to cover plate 508, to reduce friction and wear when keys, spacers, and/or tools are rotated in and out of the key case. Removable key ring 512 assembles over spacer 513, at the standoff position occupied by key 517. Spacer 514, or multiple, identical spacers, is used to fill the void or voids when the key organizer is not occupied or is partially occupied by keys and/or tools. Nylon-patch, flathead screws 515, 516 and 517: fasten cover assembly 507 to backing plate threaded standoffs 503, 504 and 505; hold keys 501, 517, 518 and 519, and spacers 513 and 514 between cover-plate assembly 507 and backing plate 502; and provide torque resistance for keys 501, 517, 518 and 519 when held in compression by disk springs 520, 521, and 522.

Figure 6:
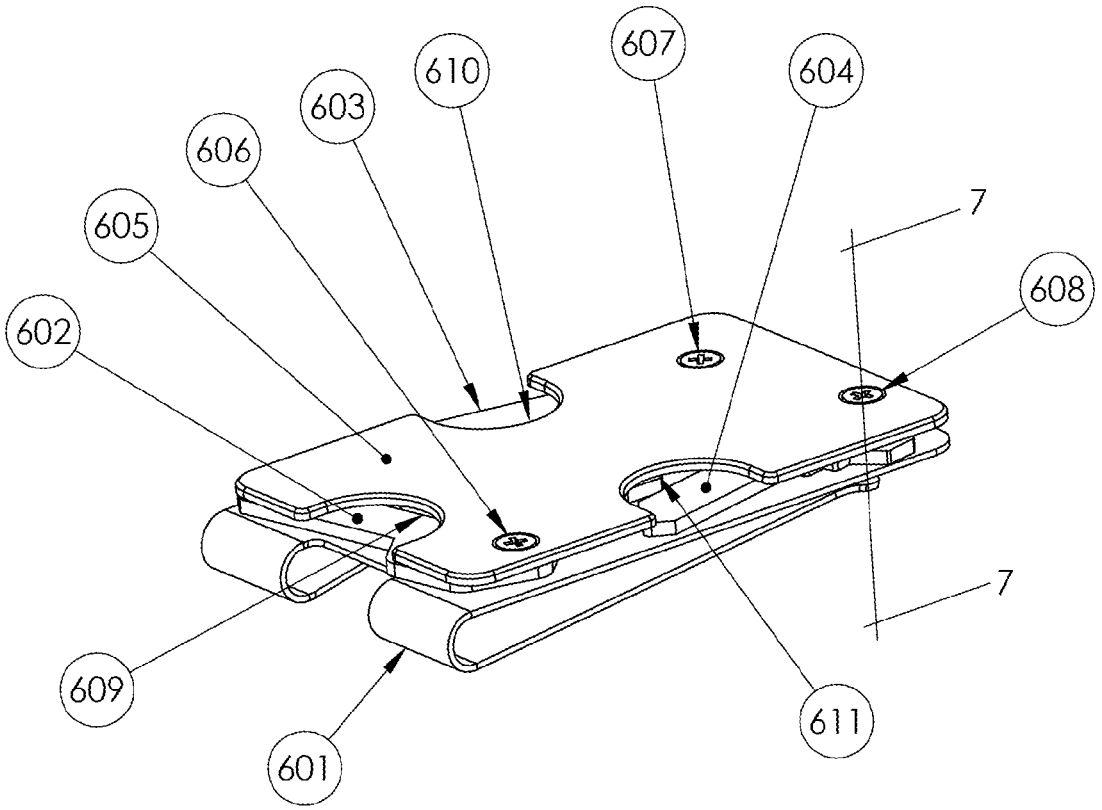
FIG. 6 shows a perspective view of a combination wallet in accordance with certain embodiments of this disclosure.

FIG. 6 shows the combination wallet of the present disclosure, with a combination backing plate 601 that holds keys 602, 603 and 604, or three spacers (not shown), or a combination of spacers and keys. Keys 602, 603 and 604 are shown in the retracted, or closed position, and the cover 605, keys and/or spacers (not shown), are held in place by flathead screws 606, 607 and 608. Cover 605 key-access slots 609, 610 and 611 are located above the retracted keys 602, 603 and 604 and are sized and positioned so keys, which pivot around screws 606, 607 and 608, can be rotated open or closed single-handedly with a thumb or index finger. The cover 605 is held in place by more than one screw, so it cannot rotate and loosen screws 606, 607 and 608 when keys or tools, such as a bottle opener or USB flash drive, are rotated in and out of the combination wallet of the present disclosure.

Figure 7:
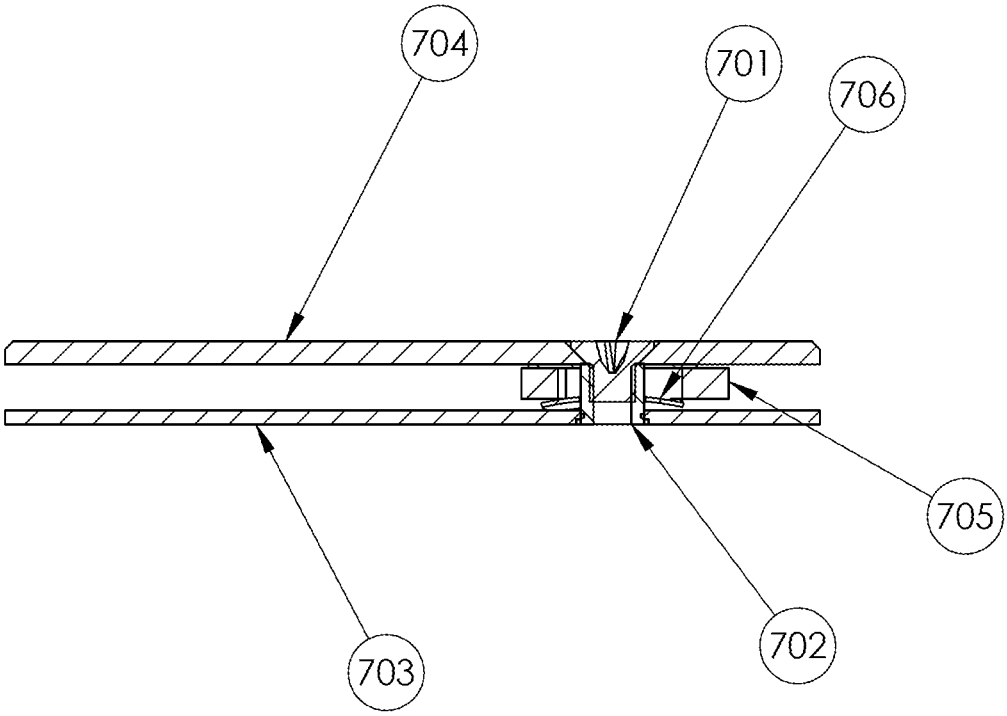
FIG. 7 shows a cross-sectional view taken along section 7-7 of FIG. 6, showing a combination wallet hardware assembly, in accordance with certain embodiments of this disclosure.

FIG. 7 shows the laminated construction of the combination wallet embodiment shown in FIG. 6. One of the three identical sets of hardware is shown, including flathead screw 701 and internally threaded backing plate standoff 702, which is press-fit into, and flush-mounted to, 1 millimeter thick combination backing plate 703. Off-shelf, internally-threaded M3 standoffs are available in 2 millimeter height increments, which match the thickness of a standard key, so metric M3 standoffs for thin sheet metal installation can be specified at heights of 4 millimeters, 6 millimeters and 8 millimeters to match stacked key thicknesses of one, two or three keys, and when installed in 0.9 millimeter-thick backing plate 703, the top of the specified standoff, illustrated by standoff 702, will always have contact with cover 704. Key 705 and disc spring 706 are held in compression between backing plate 703 and cover 704 by securely-tightened screw 701. Although a single key 705 is shown for purposes of illustration, two stacked keys, or two spacers, or a tool equaling a key thickness, such as a bottle opener or screw driver, in combination with a key or spacer, or a tool such as a USB flash drive with a height approximately equal to 4 millimeters could also be used in a combination backing plate with 6 millimeter-high standoffs. Another advantage of the construction shown in this embodiment is that off-shelf M3 metric screws with sufficient thread engagement can be used with off-shelf M3 metric standoffs, to minimize hardware costs. Combination wallet materials used in this embodiment include: nylon-patch screws, illustrated by screw 701, to resist loosening; 1 millimeter-thick, half-hard, 301 stainless steel, in combination backing plate 703, for strength, elasticity, and a minimum cross-sectional thickness to install recessed standoffs; 2 millimeter-thick 6061-T6 aluminum, in cover plate 704, for a rigid plate with sufficient thickness to recess M3 flathead screw heads, illustrated by screw 701, while minimizing weight.

Figure 8:
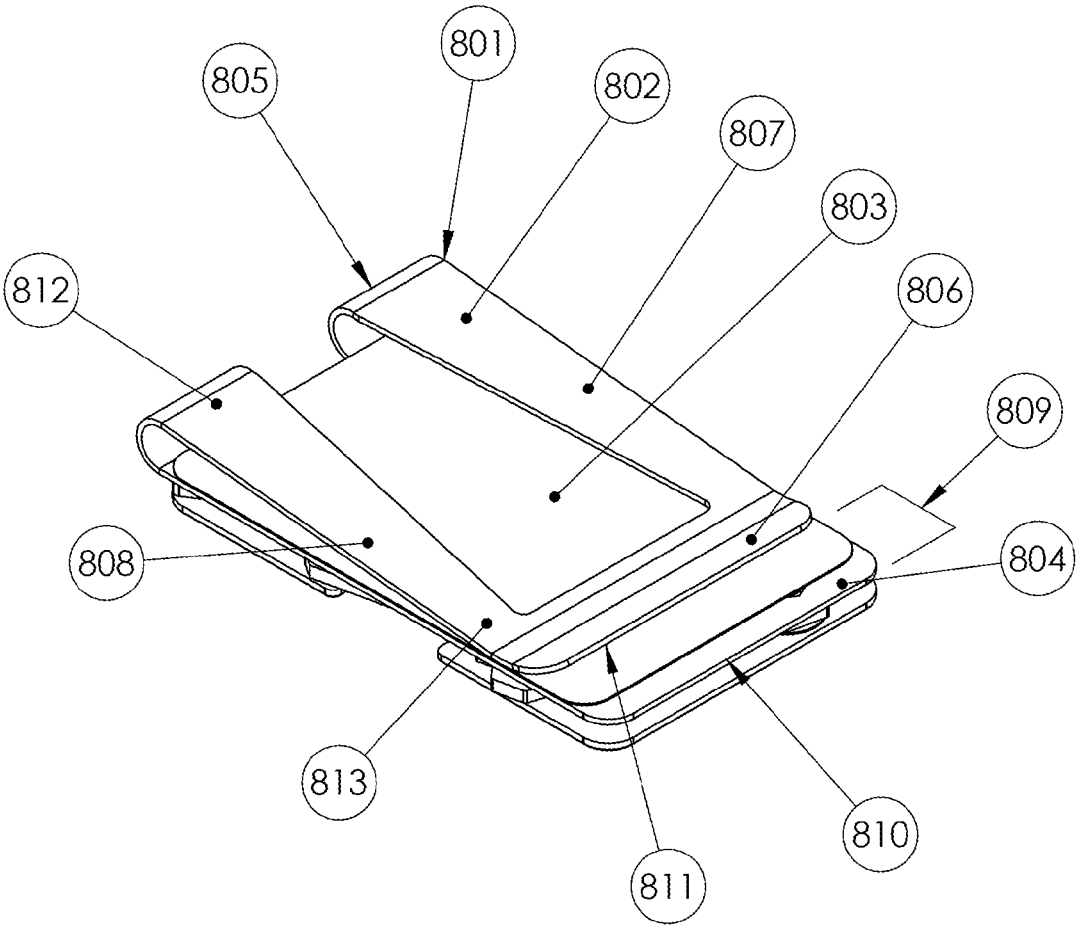
FIG. 8 shows a perspective view of a combination wallet holding an electrically conductive removable card in accordance with certain embodiments of this disclosure.

FIG. 8 shows the combination wallet, of the present disclosure, with a modified backing plate 801 having: a windowed side 802 for accessing a card 803, or multiple cards and paper currency; an unrelieved, flat side 804; and a hemmed side 805, which could alternatively replace the hem with a short, flat side, having 2 folds. The modified backing plate 801 is shown holding a single card 803 in a pre-loaded condition, but it can hold multiple cards and cash between the flat side 804, that is at least the width and length of a credit card for enveloping such cards, and the flared bridge 806 that joins two stiff, tapered leaf springs 807 and 808. The side of the modified backing plate 801 that comprises leaf springs 807 and 808 is as long as possible, to maximize leaf spring elasticity and fatigue resistance, and still provide for an adequate land 809, between the end of the flared bridge 806 and the non-hemmed end 810 of modified backing plate 801, for inserting a card or cards at an acute angle into the flared opening 811. A spring force equal to or greater than 7 pounds is preferred for securely holding cards, but such force makes opening the card clip with fingernails moderately difficult, so the fore-mentioned method of inserting a card or cards into the card clip provides a practical mechanical advantage. Leaf springs 807 and 808 are tapered, for uniform stress distribution and maximum elasticity, with a root width 812 that is twice that of the tip width 813. The card 803 shown in the present embodiment is an electrically-conductive shield for blocking radio frequencies of RFID cards which may be sandwiched between card 803 and the flat side 804 of modified backing plate 801.

Figure 9:
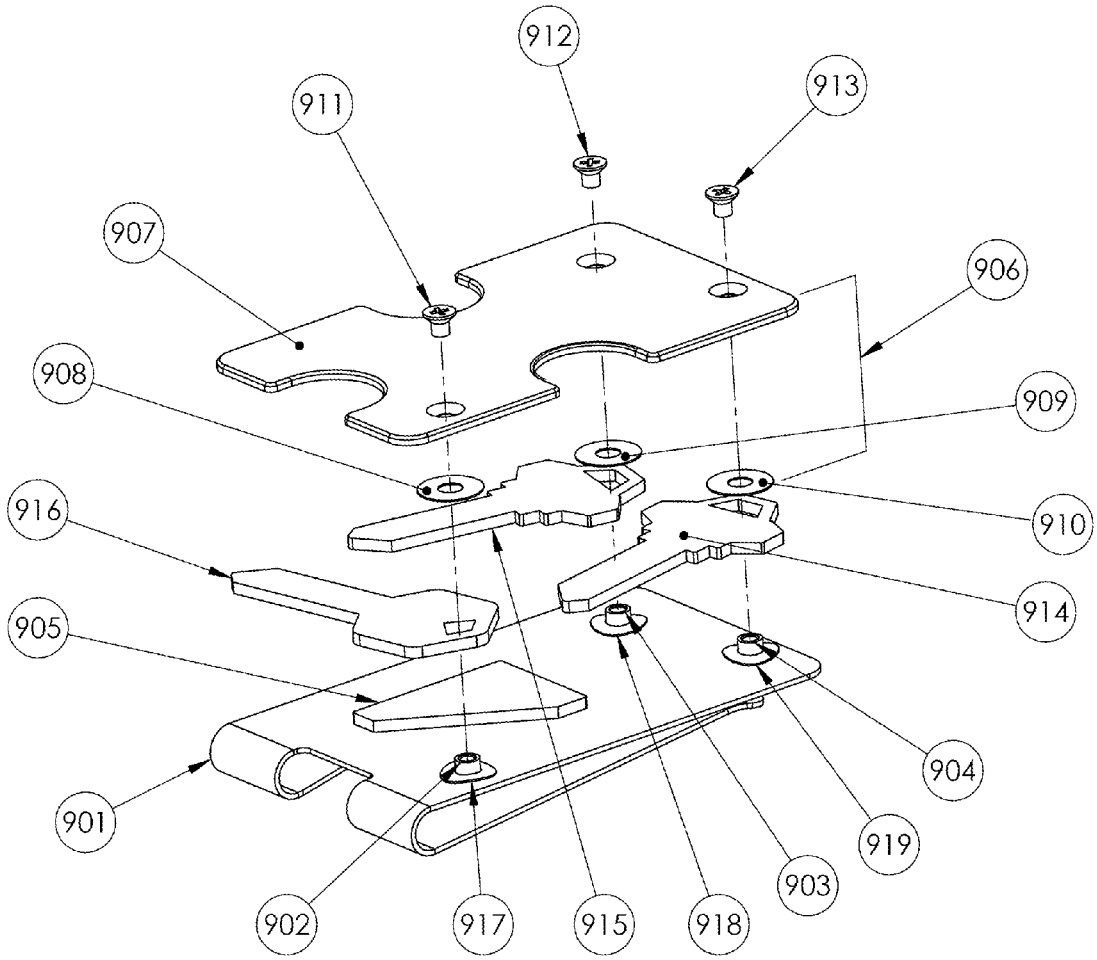
FIG. 9 shows an exploded assembly view of the FIG. 6 combination wallet in accordance with certain embodiments of this disclosure.

With reference to FIG. 6, FIG. 9 shows an exploded assembly-view of the FIG. 6 combination wallet. In this embodiment, backing plate 901 is a sub-assembly that includes internally-threaded, press-fit standoffs 902, 903 and 904, and key over-travel limit 905, that is permanently adhered to backing plate 901, and sized accordingly so that the height is less than the specified standoff height. The cover-plate assembly 906 consists of cover plate 907 and wear-resistant, thin-plastic washers 908, 909 and 910, which are permanently adhered to cover plate 907, and reduce friction and wear when keys, spacers, and/or tools are rotated in and out of the combination wallet. Spacer 514 (FIG. 5), or multiple, identical spacers, is used to fill the void or voids when the combination wallet is not occupied or is partially occupied by keys and/or tools. Nylon-patch, flathead screws 911, 912 and 913: fasten cover assembly 906 to backing plate threaded standoffs 902, 903 and 904; hold keys 913, 914 and 915 between cover-plate assembly 905 and backing plate 901; and provide torque resistance for keys 914, 915 and 916 when held in compression by disk springs 917, 918, and 919.

Figure 10:
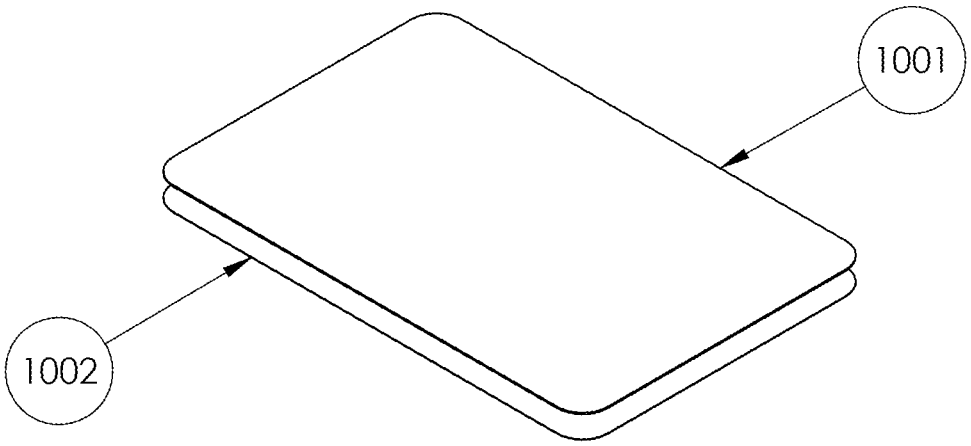
FIG. 10 shows a perspective view of an RFID-blocking shield in accordance with certain embodiments of this disclosure.

FIG. 10 shows an exploded assembly view of the RFID blocking card described by the present disclosure. In this embodiment, the RFID blocking card is fabricated from 0.5 millimeter thick composite material 1001, comprising carbon-fiber and/or fiberglass woven fabric and an epoxy or polyester resin, laminated with metalized fabric 1002, comprising a 0.075 thick, pure copper, polyester, taffeta fabric, bonded to, or molded with, material 1001. Advantages of the fore-mentioned construction include: stiffness; flexibility; rip resistance; crease resistance; durability; an effective radio frequency blocking shield on one side and a highly cosmetic surface on the other side; and an overall shield thickness that is half the thickness of a credit card.

Figure 11:
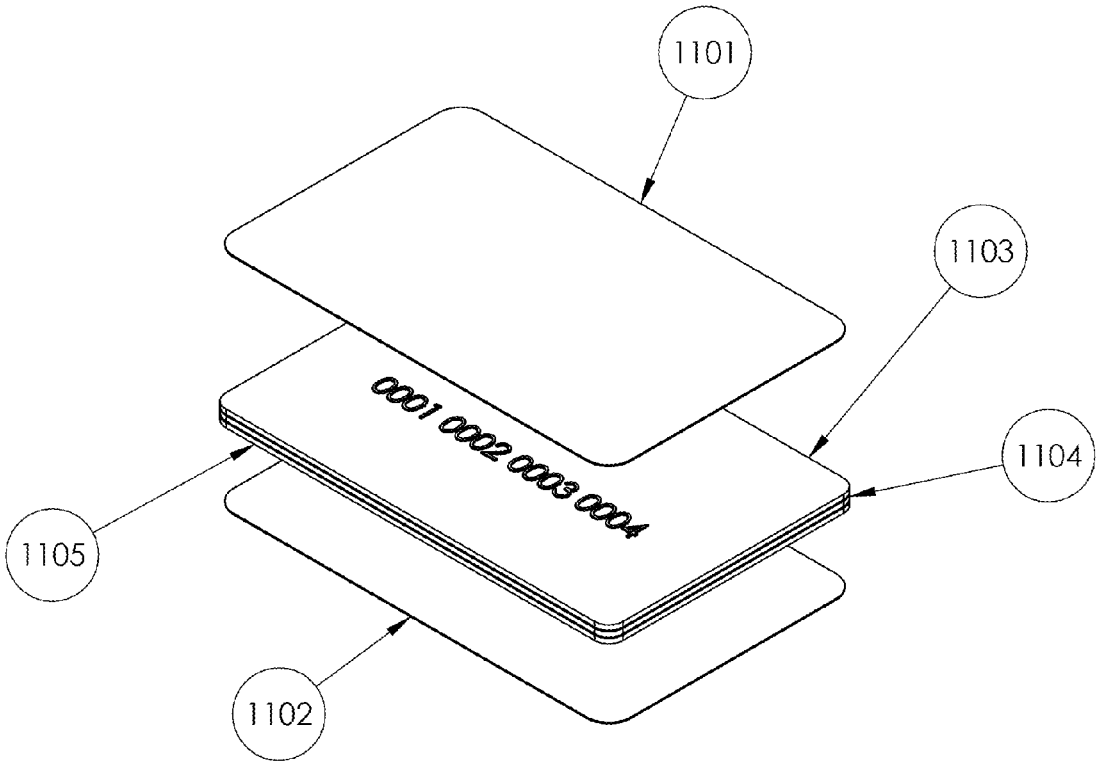
FIG. 11 shows an exploded assembly view of RFID cards placed between two RFID blocking shields in accordance with certain embodiments of this disclosure.

The FIG. 11 exploded assembly view shows two of the RFID blocking card described by FIGS. 10, 1101 and 1102, and three RFID cards 1103, 1104, and 1105. Although three RFID cards are shown in this illustration, a single card or a different multiple of cards could also be placed between RFID blocking cards 1101 and 1102, and in a fabric or leather wallet or card holder, to prevent unauthorized RFID scanning of RFID cards. The combined thickness of RFID blocking cards 1101 and 1102 is equal to one embossed credit card, so the shield adds minimal thickness to a conventional wallet or card holder and, unlike an RFID blocking sleeve, does not compromise card access.

Finally, it should be noted that there are alternative ways of implementing the embodiments disclosed herein. Accordingly, the present embodiments are to be considered as illustrative and not restrictive. Furthermore, the claims are not to be limited to the details given herein, and are entitled their full scope and equivalents thereof.

What is claimed is:

1. A card clip for holding credit cards, comprising a plate wherein, a first portion of the plate is folded back over a second portion of the plate;

the first portion comprises a window and a flared end configured to receive credit cards;

the first portion of the plate comprises two tapered leaf springs on either side of the window, wherein the window extends to form a cut-out in the second portion of the plate; and wherein each of the two tapered leaf springs is characterized by a beam length with a root width that is twice as wide as a tip; and wherein the second portion is substantially flat.

2. The card clip of claim 1, wherein, the first portion comprises a land configured to receive credit cards; and the land is in proximity to the flared end.

3. The card clip of claim 2, wherein the flared end and the land are configured to receive credit cards when the credit cards are placed at an oblique angle into a region between the flared end and the land.

4. The card clip of claim 1, comprising a separate, electrically conductive, radio frequency shield, wherein the radio frequency shield is configured to be retained by the card clip.

5. A device, comprising:

a card clip comprising:

a plate wherein a first portion of the plate is folded back over a second portion of the plate, wherein, the first portion comprises a window and a flared end configured to receive credit cards;

the first portion of the plate comprises two tapered leaf springs on either side of a window, wherein the window extends to form a cut-out in the second portion of the plate;

wherein each of the two tapered leaf springs is characterized by a beam length with a root width that is twice as wide as a tip; and the second portion is substantially flat; and at least three internally-threaded bosses mounted to an outside surface of the second portion of the clip, wherein the at least three internally-threaded bosses are peripherally arranged toward edges of the second portion and are configured to mechanically mount keys or tools; and a cover plate mounted to the backing plate, wherein the cover plate comprises key access windows configured to allow a thumb or index finger to access keys mounted on the backing plate, wherein the cover plate is mounted to the backing plate.

6. The device of claim 5, wherein the first portion comprises a land configured to receive credit cards; and the land is in proximity to the flared end.

7. The device of claim 6, wherein the flared end and the land are configured to receive credit cards when the credit cards are placed at an oblique angle, into a region between the flared end and the land.

8. The device of claim 5, wherein the cover plate comprises three or more wear-washers adhered to the underside of the cover plate; and each of the three or more wear washers is aligned with one of the three or more internally threaded bosses.

9. The device of claim 5, wherein the backing plate comprises a key over-travel limit.

10. The device of claim 5, comprising a removable and repositionable key ring mounted to the card clip or to the cover plate.

11. The device of claim 5, comprising a disc spring mounted on each of the three or more internally-threaded bosses.

* * * * *